US005092009A

United States Patent [19]

Griffith

[11] Patent Number: 5,092,009

[45] Date of Patent: Mar. 3, 1992

[54] BEDDING ANCHOR

[76] Inventor: John D. Griffith, 625 N. Kalsman Ave., Compton, Calif. 90220

[21] Appl. No.: 640,941

[22] Filed: Jan. 14, 1991

[51] Int. Cl.[5] ..... A47C 21/02

[52] U.S. Cl. ..... 5/498; 24/72.5; 24/459

[58] Field of Search ..... 5/494, 496, 498, 508; 24/72.5, 459

[56] References Cited

U.S. PATENT DOCUMENTS 2,931,084 4/1960 DeWitt ..... 24/72.5
2,939,195 6/1960 Carlson ..... 24/459
3,913,186 10/1975 Ray et al. ..... 24/459
4,660,240 4/1987 Hutton et al. ..... 24/72.5 X
4,782,543 11/1988 Hutton et al. ..... 24/72.5 X

*Primary Examiner*—Michael F. Trettel
*Attorney, Agent, or Firm*—Robert M. Sperry

[57] ABSTRACT

An improved bedding anchor comprising a first member having a generally T-shaped slot formed therein to receive a portion of the edge of a sheet, a cylindrical retaining member, an anchor member engageable with a fixed portion of the bed, and elastic means securing said first member to said anchor member.

10 Claims, 2 Drawing Sheets

BEDDING ANCHOR

BACKGROUND

1. Field of Invention

This invention relates to bedding anchors and is particularly directed to apparatus for anchoring the sides of bedsheets and the like to prevent wrinkling or dislocation of the sheet by a person occupying the bed.

2. Prior Art

In hospitals, rest homes and the like, where patients spend considerable periods of time in bed and, often, are unable to leave the bed for more that a short period of time, if at all, the problem of sheet wrinkles can become a major concern, causing great discomfort to the patients and tending to cause skin irritation and to create bed sores which can become infected and, hence, may lead to serious complications. Unfortunately, no matter how tightly the sheets are drawn, during the process of making the bed, movement of the patient will, eventually, cause some loosening of the sheet and, thereby will create wrinkles. Obviously, it is impractical to provide continual attention for every patient, so that the sheets can be retightened whenever wrinkles occur. However, even when such constant attention is possible, as with full-time private nursing, some wrinkling invariably occurs.

Numerous devices have been proposed, heretofore, to overcome these difficulties. However, many of the prior art bedding anchors have served only to retain the corners of the bedding which aids in preventing dislocation of the sheets, but does little to prevent wrinkles. Other prior art bedding anchors have been provided inadequate gripping and, hence, have tended to slip and become ineffective. Still other prior art bedding anchors have been expensive to purchase and complicated to use. Again, some prior art bedding anchors have been effective when a patient is relatively quiet, but tend to become loosened when the patient is unsually restless. A search in the United States Patent Office has revealed the following references:

| U.S. PAT. NO. | INVENTOR | ISSUED |
|---|---|---|
| 2,931,084 | H. K. De Witt | Apr. 5, 1960 |
| 2,988,759 | V. E. Gerdes | Jun. 20, 1961 |
| 3,092,848 | G. B. Gronvold | Jun. 11, 1963 |
| 4,276,667 | B. C. Osbourne | Jul. 7, 1981 |

Each of these patents is subject to the objections noted above. Thus, none of the prior art bedding anchors have been entirely satisfactory.

BRIEF SUMMARY AND OBJECTS OF INVENTION

These disadvantages of prior art bedding anchors are overcome and improved bedding anchors are provided which are inexpensive to produce and purchase and which are simple to install, yet which serve to securely retain the edge of a sheet and, hence, to prevent wrinkles, even when the occupant of the bed is extremely restless.

The advantages of the present invention are preferably attained by providing an improved bedding anchor comprising a first member having a generally T-shaped slot formed therein to receive a portion of the edge of a sheet, a cylindrical retaining member, an anchor member engageable with a fixed portion of the bed, and elastic means securing said first member to said anchor member.

Accordingly, it is an object of the present invention to provide an improved bedding anchor.

Another object of the present invention is to provide an improved bedding anchor which is inexpensive to purchase and simple to install.

A further object of the present invention is to provide an improved bedding anchor which serves to securely retain the edge of a sheet and, hence, to prevent wrinkles, even when the occupant of the bed is extremely restless.

A specific object of the present invention is to provide an improved bedding anchor comprising a first member having a generally T-shaped slot formed therein to receive a portion of the edge of a sheet, a cylindrical retaining member, an anchor member engageable with a fixed portion of the bed, and elastic means securing said first member to said anchor member.

These and other objects and features of the present invention will be apparent from the following detailed description, taken with reference to the figures of the accompanying drawings.

DETAILED DESCRIPTION OF THE INVENTION

Figure 1:
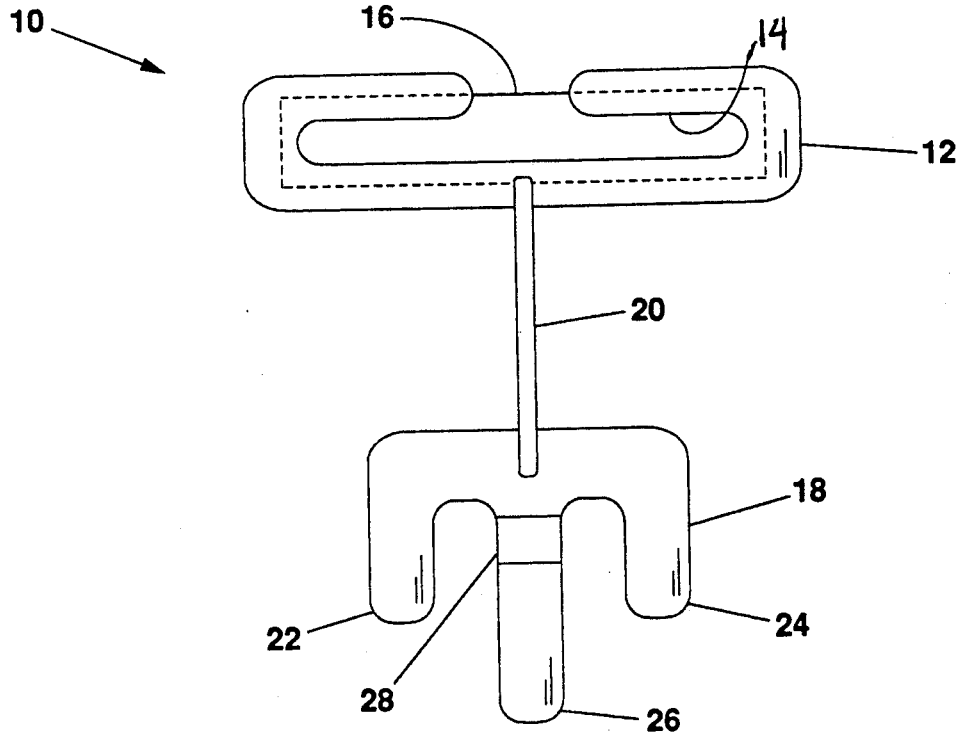
FIG. 1 is a front view of a bedding anchor embodying the present invention.
Figure 2:
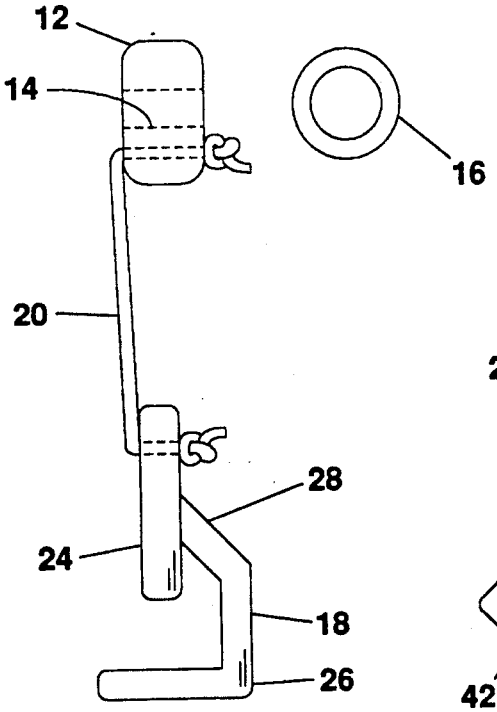
FIG. 2 is a side view of the bedding anchor of FIG. 1.

In that form of the present invention chosen for purposes of illustration in FIG. 1, a bedding anchor is shown, indicated generally at 10, having an upper member 12 formed with a generally T-shaped opening 14, a generally cylindrical retaining member 16 and a tined anchor member 18 joined to the upper member 12 by a flexible member 20, such as a bungee cord. As shown, the anchor member 18 is formed with two outer legs 22 and 24 and a central leg 26 which is laterally offset from the plane of the outer legs 22 and 24, as indicated at 28. However, it will be apparent that, if desired, the anchor member 18 could be formed with a single leg. The upper member 12, retaining member 16 and anchor member 18 are preferably formed of relatively rigid material, such as wood, metal or rigid plastic and the retaining member 16 may be either tubular, as shown or a solid cylinder, as desired.

Figure 3:
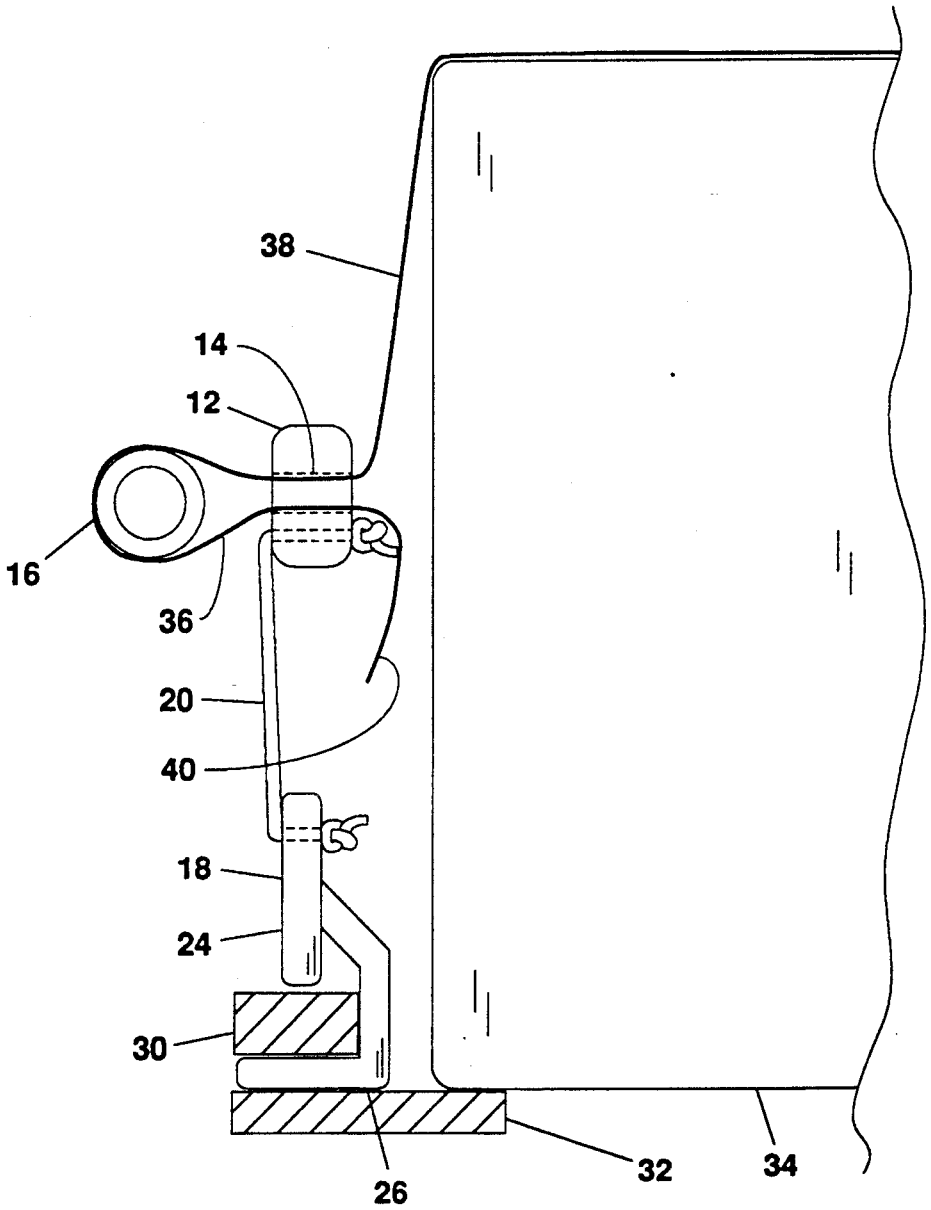
FIG. 3 is a diagrammatic view showing the bedding anchor of FIG. 1 being employed to anchor a sheet.

In use, the anchor member 18 is hooked onto the frame 30 of a bed, adjacent a support 32 for a bed spring 34 or the like. A loop 36 of sheet 38 adjacent the lower edge 40 is drawn through the T-shaped opening 14 of upper member 12 and the retaining member 16 is inserted into the loop 36, as seen in FIG. 3. Since, as seen in FIG. 1, the retaining member 16 is larger than the T-shaped opening 14, the retaining member 16 prevents the loop 36 of sheet 38 from being withdrawn through the opening 14 and, hence, since the upper member 12 is attached to the anchor member 18 by the flexible member 20, the bedding anchor 10 serves to retain the lower edge 40 of the sheet 38 in a desired position. If the patient moves about in the bed in a manner to pull on the sheet 38, the flexible member 20 will allow the edge 40 of the sheet 38 to move accordingly. However, the flexible member 20 will cause the upper member 12 and retaining member 16 to maintain tension on the edge 40 of the sheet 38, so that if the patient moves in a manner to relieve the stress on the sheet 38, the flexible member 20 will automatically adjust for this by pulling on the upper member 12 and, hence, on the lop 36 of the sheet 38 to assure that tension is constantly maintained on the sheet 38 so that the sheet 38 does not become limp and wrinkles are prevented. It is preferred that a plurality, three, for example, of the bedding anchors 10 be applied along each side of a bed to provide more uniform tension on the sheet 38 and, hence, to more completely prevent wrinkles.

Figure 4:
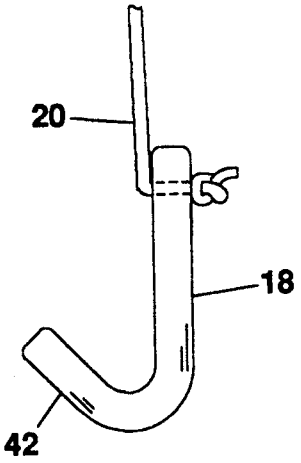
FIG. 4 is a side view of an alternative form of the anchor portion of the bedding anchor of FIG. 1.
Figure 5:
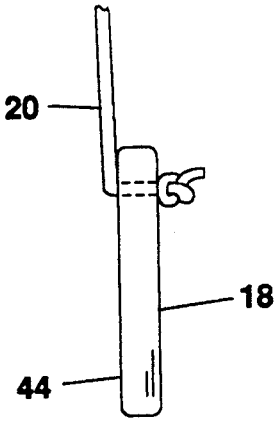
FIG. 5 is a side view of a further alternative form of the anchor portion of the bedding anchor of FIG. 1 for use with water beds.

FIG. 4 shows an alternative form of the anchor member 18 of the bedding anchor 10 for use with metal beds. In this form of the invention, the anchor member 18 is formed with a generally J-shaped hook portion 42, which may or may not be tined. The generally J-shaped hook portion 42 facilitates attachment to bed frames having rounded configurations, such as are found in metal beds. Similarly, FIG. 5 shows a further alternative form of the anchor member 18 which is flat, as seen at 44 in FIG. 5. This form of the anchor member 18 is intended for use in anchoring bedding on a water bed or the like having a frame with no openings which would accommodate hook-type anchor members 18, such as those of FIGS. 1–4.

Obviously, numerous other variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A bedding anchor comprising:

a first member having a generally T-shaped slot formed therein to receive a portion of the edge of a sheet, a cylindrical retaining member dimensioned to preclude entry of said retaining member into said slot, an anchor member engageable with a fixed portion of the bed, and elastic means securing said first member to said anchor member.

2. The bedding anchor of claim 1 wherein:

said first member, said retaining member and said anchor member are formed of rigid material.

3. The bedding anchor of claim 1 wherein:

said elastic member is a bungee cord.

4. The bedding anchor of claim 1 wherein:

said anchor member is formed with a hooked leg for releasable engagement with a portion of a bed frame.

5. The bedding anchor of claim 4 wherein:

said anchor member is tined, having a pair of outer legs and a central leg formed with an offset portion for releasable engagement with a portion of a bed frame.

6. The bedding anchor of claim 4 wherein: said hooked leg is generally J-shaped.

7. The bedding anchor of claim 1 wherein: said anchor member is flat.

8. The bedding anchor of claim 1 wherein: said retaining member is tubular.

9. A bedding anchor comprising:

a first member having a generally T-shaped slot formed therein to receive a portion of the edge of a sheet, a cylindrical retaining member, an anchor member engageable with a fixed portion of the bed, said anchor member being tined, having a pair of outer legs and a central hooked leg formed with an offset portion for releasable engagement with a portion of a bed frame, and elastic means securing said first member to said anchor member.

10. A bedding anchor comprising:

a first member having a generally T-shaped slot formed therein to receive a portion of the edge of a sheet, a tubular cylindrical retaining member, an anchor member engageable with a fixed portion of the bed, and elastic means securing said first member to said anchor member.

* * * * *